US010101691B2

(12) United States Patent
Saitoh

(10) Patent No.: US 10,101,691 B2
(45) Date of Patent: Oct. 16, 2018

(54) FIXING DEVICE AND IMAGE FORMING APPARATUS

(71) Applicant: Seiji Saitoh, Kanagawa (JP)

(72) Inventor: Seiji Saitoh, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/176,846

(22) Filed: Jun. 8, 2016

(65) Prior Publication Data

US 2016/0378032 A1 Dec. 29, 2016

(30) Foreign Application Priority Data

Jun. 25, 2015 (JP) ..... 2015-127798
Feb. 12, 2016 (JP) ..... 2016-024644

(51) Int. Cl.
*G03G 15/20* (2006.01)

(52) U.S. Cl.
CPC . *G03G 15/2028* (2013.01); *G03G 2215/0132* (2013.01)

(58) Field of Classification Search
CPC ..... G03G 15/2028; G03G 15/2039; G03G 15/657; G03G 15/6573; G03G 2215/2032; G03G 15/2053; G03G 15/2085; G03G 15/6502; G03G 15/0865; G03G 15/2003; G03G 15/6529; G03G 21/1623; G03G 21/1628; B41J 13/28; B41J 15/005; B41J 2202/37; B41J 2/01; B41J 2/175; B41J 2/32; B41J 3/44; B41J 3/60; H04N 1/00615; H04N 1/0066; H04N 5/3696; H04N 1/0057
See application file for complete search history.

(56) References Cited

U.S. PATENT DOCUMENTS 5,608,512 A * 3/1997 Endo ..... G03G 15/2028 399/323
9,256,171 B2 * 2/2016 Moon ..... G03G 15/2028
2002/0131801 A1 9/2002 Tomatsu
2006/0198669 A1 9/2006 Ohba
2009/0003910 A1 * 1/2009 Kobayashi ..... G03G 15/2028 399/400
2014/0233991 A1 8/2014 Moon et al.
(Continued)

FOREIGN PATENT DOCUMENTS

CN 1804731 A 7/2006
JP 2002-278329 9/2002
JP 2006-133326 5/2006
(Continued)

OTHER PUBLICATIONS

Chinese Office Action dated Aug. 3, 2018 for Chinese Patent Application No. 201610443460.0.

*Primary Examiner* — Roy Y Yi
(74) *Attorney, Agent, or Firm* — Oblon, McClelland, Maier & Neustadt, L.L.P.

(57) ABSTRACT

A fixing device includes a fixing rotator, a pressing rotator, and a guide. The pressing rotator forms a fixing nip with the fixing rotator. The guide guides a recording medium to the fixing nip. The guide includes a guide surface that contacts a surface of the recording medium against a guide the recording medium. The guide surface is provided parallel to a line tangent to the fixing rotator and the pressing rotator.

16 Claims, 6 Drawing Sheets

(56) References Cited

U.S. PATENT DOCUMENTS

2015/0097014 A1* 4/2015 Makida ..... B65H 20/02
226/183

FOREIGN PATENT DOCUMENTS

| | | | |
|---|---|---|---|
| JP | 2006-133329 | A | 5/2006 |
| JP | 2006-285076 | | 10/2006 |
| JP | 2008-064834 | | 3/2008 |
| JP | 2009-288711 | | 12/2009 |
| JP | 2010-039318 | | 2/2010 |
| JP | 2015-087520 | | 5/2015 |

* cited by examiner

FIXING DEVICE AND IMAGE FORMING APPARATUS

CROSS-REFERENCE TO RELATED APPLICATIONS

This patent application is based on and claims priority pursuant to 35 U.S.C. § 119 to Japanese Patent Application No. 2015-127798 filed on Jun. 25, 2015, and Japanese Patent Application No. 2016-024644 filed on Feb. 12, 2016 in the Japan Patent Office, the entire disclosure of each of which is hereby incorporated by reference herein.

BACKGROUND

Technical Field

Exemplary aspects of the present invention relate to a fixing device and an image forming apparatus, such as a copier, a printer, a facsimile machine, or a multi-function peripheral including the fixing device, the multi-function peripheral having at least two of the copying, printing, and facsimile functions.

Related Art

Image forming apparatuses such as copiers, printers, facsimile machines, or multi-function peripherals having at least two of copying, printing, and facsimile functions include a fixing device that fixes a developer image on a recording medium. The fixing device includes a fixing rotator and a pressing rotator to form a fixing nip through which the recording medium is passed, so that the developer image on the recording medium is fixed with heat and pressure in the fixing nip. Such a fixing device includes a guide for correctly guiding the recording medium to the fixing nip.

For example, as illustrated in FIG. 9, a fixing device includes an inlet guide 102, a heating roller 100, and a pressing roller 101. The heating roller 100 and the pressing roller 101 form a fixing nip N9. The inlet guide 102 is disposed on an upstream side of the fixing nip N9 in a sheet conveyance direction. A sheet P is guided and conveyed to the fixing nip N9 by the inlet guide 102 while contacting a leading end contact portion 102*a* of the inlet guide 102. Thus, the sheet P is conveyed in an S-curved state, and the leading end contact portion 102*a* cancels out a conveyance speed difference between a front surface and a back surface of the sheet P.

SUMMARY

In at least one embodiment of this disclosure, there is provided an improved fixing device that includes a fixing rotator, a pressing rotator, and a guide. The pressing rotator forms a fixing nip with the fixing rotator. The guide guides a recording medium to the fixing nip. The guide includes a guide surface that contacts a surface of the recording medium against a guide the recording medium. The guide surface is provided parallel to a line tangent to the fixing rotator and the pressing rotator.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
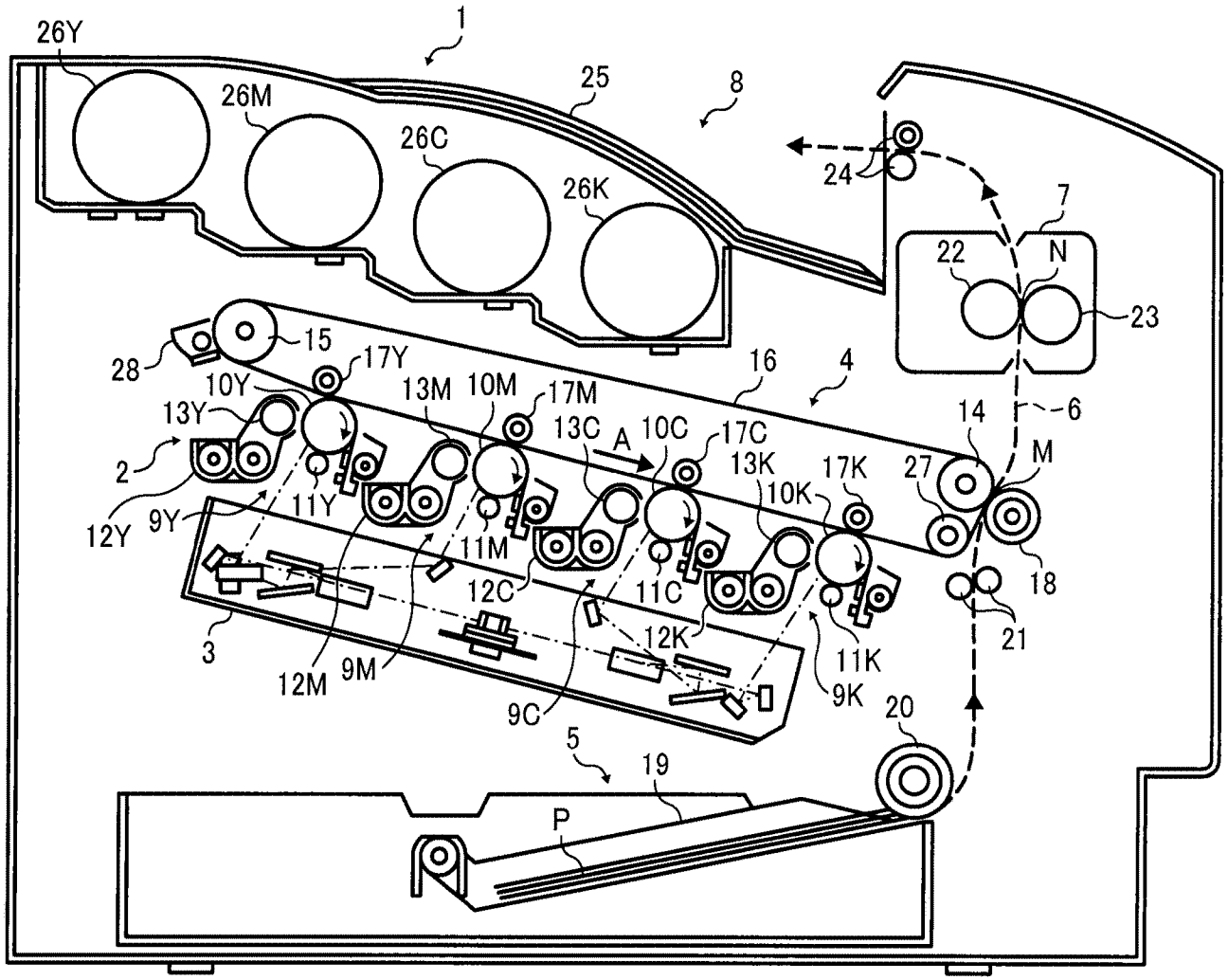
FIG. 1 is a schematic diagram of an image forming apparatus including a fixing device according to an exemplary embodiment of the present invention.

The accompanying drawings are intended to depict exemplary embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that have a similar function, operate in a similar manner, and achieve similar results.

Referring now to the drawings, exemplary embodiments of the present disclosure are described below. In the drawings for explaining the following exemplary embodiments, the same reference codes are allocated to elements (members or components) having the same function or shape and redundant descriptions thereof are omitted below.

In FIG. 1, a color image forming apparatus 1 includes an image forming unit 2 in a middle portion thereof. The image forming unit 2 includes four process units 9Y, 9M, 9C, and 9K, each of which is detachably disposed. The process units 9Y, 9M, 9C, and 9K respectively store yellow (Y), magenta (M), cyan (C), and black (K) developers of different colors for color separation components of a color image. Each of the process units 9Y, 9M, 9C, and 9K is substantially similar to every other except for the color of developer therein.

In particular, the process units 9Y, 9M, 9C, and 9K respectively include photoconductor drums 10Y, 10M, 10C, and 10K, charging rollers 11Y, 11M, 11C, and 11K, and developing devices 12Y, 12M, 12C, and 12K. Each of the photoconductor drums 10Y, 10M, 10C, and 10K as drum-shaped rotators includes a surface that can bear toner serving as developer. The charging rollers 11Y, 11M, 11C, and 11K uniformly charge the surfaces of the respective photoconductor drums 10Y, 10M, 10C, and 10K. The developing devices 12Y, 12M, 12C, and 12K respectively include developing rollers 13Y, 13M, 13C, and 13K that supply toner to the surfaces of the respective photoconductor drums 10Y, 10M, 10C, and 10K.

Moreover, in an upper portion of the image forming apparatus 1, toner bottles 26Y, 26M, 26C, and 26K respectively filled with yellow, cyan, magenta, and black toners are detachably arranged. The yellow, cyan, magenta, and black toners stored in the toner bottles 26Y, 26M, 26C, and 26K are respectively supplied to the developing devices 12Y, 12M, 12C, and 12K via supply paths arranged between the toner bottles 26Y, 26M, 26C, and 26K and the respective developing devices 12Y, 12M, 12C, and 12K.

Moreover, the image forming apparatus 1 includes an exposure unit 3 disposed below the process units 9Y, 9M, 9C, and 9K. The exposure unit 3 emits a laser beam based on image data.

The image forming apparatus 1 includes a transfer unit 4 disposed above the image forming unit 2. The transfer unit 4 includes an endless intermediate transfer belt 16, primary transfer rollers 17Y, 17M, 17C, and 17K, a secondary transfer roller 18 as a transfer rotator, a secondary transfer backup roller 14 as an opposite rotator, a cleaning backup roller 15, a tension roller 27, and a belt cleaning device 28. The primary transfer rollers 17Y, 17M, 17C, and 17K are arranged in positions opposite the respective photoconductor drums 10Y, 10M, 10C, and 10K of the process units 9Y, 9M, 9C, and 9K with the intermediate transfer belt 16 therebetween.

The intermediate transfer belt 16 is an endless belt and is entrained around the secondary transfer backup roller 14, the cleaning backup roller 15, and the tension roller 27. Herein, rotation of the secondary transfer backup roller 14 moves (rotates) the intermediate transfer belt 16 in a direction indicated by an arrow A shown in FIG. 1.

The four primary transfer rollers 17Y, 17M, 17C, and 17K and the respective photoconductor drums 10Y, 10M, 10C, and 10K nip the intermediate transfer belt 16 to form primary transfer nips. Each of the primary transfer rollers 17Y, 17M, 17C, and 17K is connected to a power source so as to receive a predetermined direct current (DC) voltage and/or a predetermined alternating current (AC) voltage.

The secondary transfer roller 18 and the secondary transfer backup roller 14 nip the intermediate transfer belt 16 to form a secondary transfer nip M as a transfer nip. Similar to the primary transfer rollers 17Y, 17M, 17C, and 17K, the secondary transfer roller 18 is connected to a power source so as to receive a predetermined DC voltage and/or a predetermined AC voltage.

The belt cleaning device 28 includes a cleaning brush and a cleaning blade that are arranged to contact the intermediate transfer belt 16. A waste toner collected by the belt cleaning device 28 is stored in a waster toner bottle via a waster toner transporting hose.

A sheet feeding unit 5 is disposed in a lower portion of the image forming apparatus 1. The sheet feeding unit 5 includes a sheet cassette 19 for storing sheets P as recording media, and a sheet feeding roller 20 for conveying a sheet P from the sheet cassette 19.

A sheet P fed from the sheet feeding unit 5 is conveyed along a conveyance path 6. A plurality of conveyance roller pairs including a registration roller pair 21 is arranged as appropriate along the conveyance path 6 to a sheet ejection unit 8.

A fixing device 7 includes a fixing roller 22 as a fixing rotator, and a pressing roller 23 as a pressing rotator. The fixing roller 22 is heated by a heat source, and the pressing roller 23 can press the fixing roller 22. The pressing roller 23 and the fixing roller 22 form a fixing nip N.

The sheet ejection unit 8 is disposed on the extreme downstream side of the conveyance path 6 in the image forming apparatus 1. The sheet ejection unit 8 includes a pair of ejection rollers 24 for ejecting the sheet P outside, and an ejection tray 25 on which the ejected sheet P is stacked.

The image forming unit 2, the exposure unit 3, and the transfer unit 4 function to form an image on the sheet P.

Hereinafter, a basic operation of the image forming apparatus 1 is described with reference to FIG. 1.

When the image forming apparatus 1 starts an image forming operation, electrostatic latent images are formed on surfaces of the photoconductor drums 10Y, 10M, 10C, and 10K of the respective process units 9Y, 9M, 9C, and 9K. Herein, the exposure unit 3 emits beams to the photoconductor drums 10Y, 10M, 10C, and 10K based on image information that is single color image information obtained by dividing a desired full-color image into color information of yellow, cyan, magenta, and black. When the electrostatic latent images are formed on the photoconductor drums 10Y, 10M, 10C, and 10K, the drum-shaped developing rollers 13Y, 13M, 13C, and 13K respectively supply the toners stored in the developing devices 12Y, 12M, 12C, and 12K to the photoconductor drums 10Y, 10M, 10C, and 10K. Thus, the electrostatic latent images become visible as toner images (developer images).

In the transfer unit 4, when the secondary transfer backup roller 14 is rotated, the intermediate transfer belt 16 moves in a direction indicated by the arrow A shown in FIG. 1. Moreover, a constant voltage or a voltage with current that is maintained constant is applied to each of the primary transfer rollers 17Y, 17M, 17C, and 17K, the constant voltage or the constant current voltage having a polarity opposite to a toner charge polarity. This forms transfer electric fields in the primary transfer nips, so that the toner images on the photoconductor drums 10Y, 10M, 10C, and 10K are sequentially superimposed and transferred to the intermediate transfer belt 16 in the primary transfer nips.

Meanwhile, in the lower portion of the image forming apparatus 1, the sheet feeding roller 20 of the sheet feeding unit 5 is rotated to feed a sheet P stored in the sheet cassette 19 to the conveyance path 6 when the image forming apparatus 1 starts the image forming operation. The registration roller pair 21 times conveyance of the sheet P fed to the conveyance path 6, so that the sheet P is conveyed to the secondary transfer nip M between the secondary transfer roller 18 and the secondary transfer backup roller 14. Herein, a transfer voltage having a polarity opposite to the toner charge polarity of the toner image on the intermediate transfer belt 16 is being applied, and a transfer electric field is being formed in the secondary transfer nip M. With the electric field in the secondary transfer nip, the toner images on the intermediate transfer belt 16 are collectively transferred to the sheet P.

The sheet P with the transferred toner image is conveyed to the fixing device 7, so that the toner image is fixed on the sheet P with heat and pressure applied by the fixing roller 22 and the pressing roller 23. Subsequently, the sheet P with the fixed image is separated from the fixing roller 22 and then conveyed by the conveyance roller pair to the sheet ejection unit 8 in which the sheet P is ejected by the ejection roller pair 24 to the ejection tray 25.

The image forming operation has been described using an example case in which a full-color image is formed on a sheet P. However, the image forming operation can be applied to a case in which a single color image is formed using any one of the four process units 9Y, 9M, 9C, and 9K, or a two-color image or a three-color image is formed using two or three out of the four process units 9Y, 9M, 9C, and 9K.

On the conveyance path 6, a guide 30 for guiding the sheet P to the fixing nip N of the fixing device 7 is disposed on an upstream side of the fixing device 7 in a conveyance direction of the sheet P (hereinafter, the conveyance direction of the sheet P is also called a conveyance direction).

Figure 2:
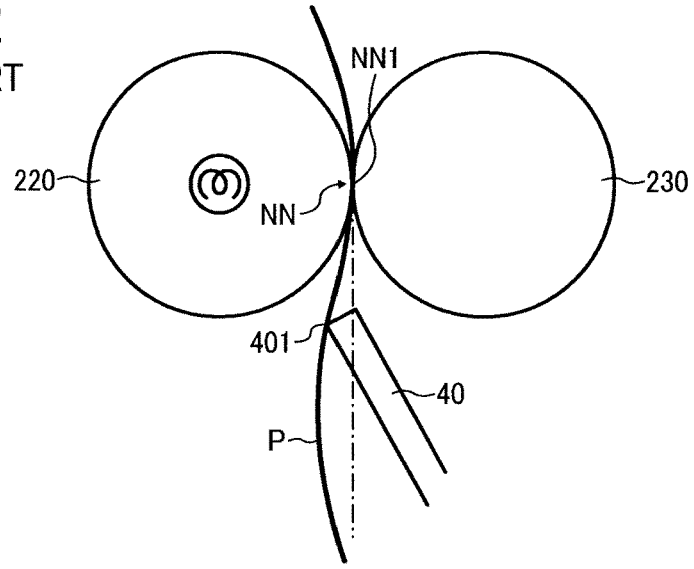
FIG. 2 PRIOR ART
FIG. 2 is a sectional view of a related-art fixing device.

FIG. 2 is a diagram of a related-art fixing device including a fixing roller 220, a pressure roller 230, and a guide 40. In FIG. 2, the guide 40, made of a resin material, is disposed on an upstream side of a fixing nip NN including a fixing nip surface NN1 in a conveyance direction. The guide 40 includes an edge portion 401 that contacts a sheet P at a point to guide the sheet P to the fixing nip NN.

In such a configuration, however, an electric charge tends to be accumulated in a position of the edge portion 401. When a surface of the sheet P slides against the edge portion 401, the edge portion 401 is charged. This causes a problem of irregularity in a toner image on the surface of the sheet P.

The guide preferably has an electrical resistance of approximately $10^8\Omega$ to approximately $10^{12}\Omega$. In a case in which the guide is made of a conductive material, an electric charge retained by the sheet P or an electric charge applied to the sheet P by a transfer unit flows to the guide when the sheet P contacts the guide. This causes the irregularity in the toner image on the sheep P and a transfer process failure in the transfer unit. Although such failures can be prevented if a coating agent or a paste having moderate electrical resistance is applied to a surface of the guide, the cost of the guide increases as a result.

Moreover, in a case in which a guide is made of a non-conductive material similar to the related-art guide 40 illustrated in FIG. 2, the guide is charged when a sheet P slides against the guide. This causes an irregularity in a toner image on the sheet P. Such a failure can be resolved if electrical resistance is reduced by adding a material such as carbon to the guide. However, such a method causes an increase in cost and degradation in moldability.

The guide 30 of the present exemplary embodiment is configured to solve such problems. Hereinafter, the guide 30 is described.

Figure 3:
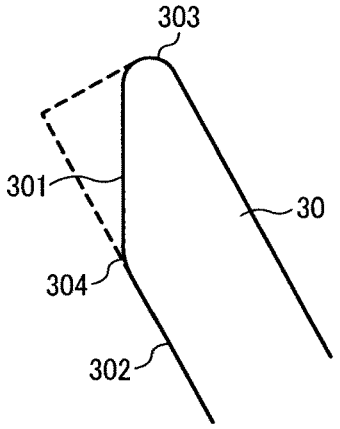
FIG. 3 is a schematic diagram of a guide in the fixing device illustrated in FIG. 1.

According to the present exemplary embodiment, as illustrated in FIG. 3, a portion of the guide 30 on a downstream side in the conveyance direction is chamfered toward the fixing roller 22 (the chamfered portion is indicated by a dotted line in FIG. 3). The guide 30 includes a first guide surface 301 and a second guide surface 302 each serving as a guide surface for guiding a sheet P to the fixing nip N. The first guide surface 301 and the second guide surface 302 are continuous with each other. A boundary 304 as a border between the first guide surface 301 and the second guide surface 302 has a curved surface with a radius of 0.2 mm to 0.3 mm. Since the boundary 304 has the curved surface, a friction with the sheet P in the boundary 304 can be reduced. The first guide surface 301 includes an end portion 303 as a downstream end portion on the downstream side in a conveyance direction.

Next, relative positions of the guide 30 and each components of the fixing device 7 according to the present exemplary embodiment of the present invention is described with reference to FIG. 4.

Figure 4:
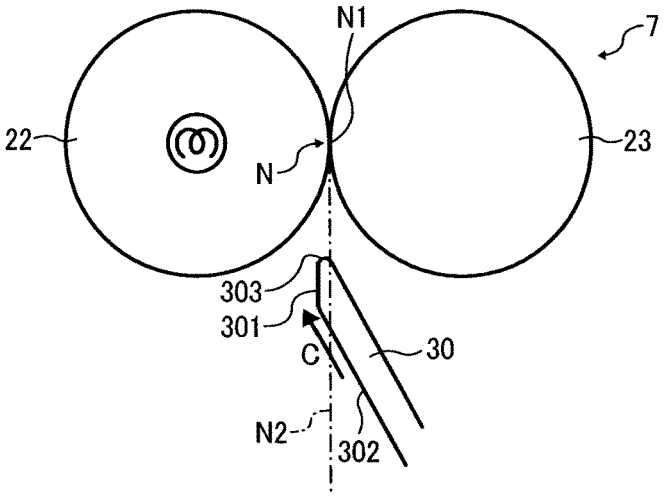
FIG. 4 is a sectional view illustrating a configuration of the fixing device of the image forming apparatus of FIG. 1.
Figure 5:
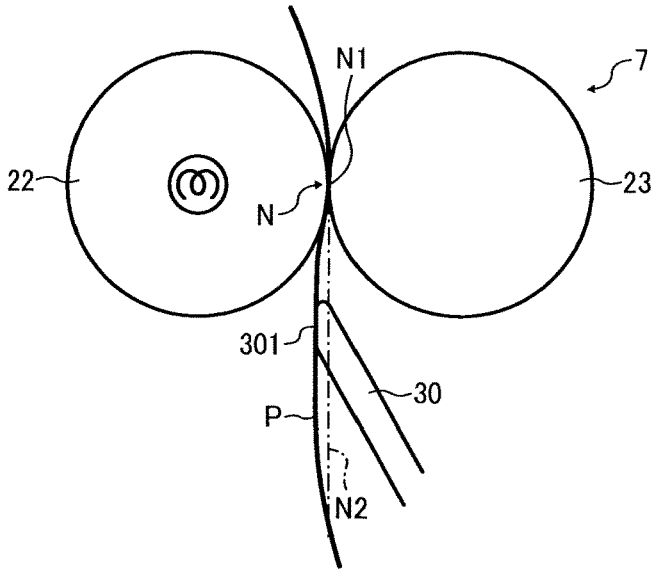
FIG. 5 is a sectional view illustrating a state in which a sheet is conveyed.

In the present exemplary embodiment, as illustrated in FIG. 4, the first guide surface 301 is disposed parallel to a line tangent N2 to the fixing roller 22 and the pressing roller 23 (or a fixing nip surface N1 of the fixing nip N). Accordingly, as illustrated in FIG. 5, when a sheet P is conveyed to the fixing nip N, such arrangement enables the first guide surface 301 to guide the sheet P to the fixing nip N while a surface of the first guide surface 301 contacts the sheet P as a plane without projections with respect to the sheet P.

The first guide surface 301 is provided on the extreme downstream side of the guide 30 in the conveyance direction. Moreover, as illustrated in FIG. 4, the end portion 303 of the first guide surface 301 and an inlet portion of the fixing nip N are spaced apart by approximately 7 mm to approximately 10 mm.

As illustrated in FIG. 4, the second guide surface 302 is an inclined surface that is inclined from the side of the pressing roller 23 toward the side of the fixing roller 22 from the upstream side to the downstream side in the conveyance direction. Such an inclined surface of the second guide surface 302 enables the sheet P to be guided to a direction indicated by an arrow C shown in FIG. 4 and to the side of the fixing roller 22. Since the second guide surface 302 has a major function of guiding a leading end of the sheet P, the second guide surface 302 preferably has smoothness with a low friction coefficient.

Moreover, the entire area of the first guide surface 301 (in particular, the end portion 303 of the first guide surface 301) is arranged on the side of the fixing roller 22 relative to the line tangent N2.

Such arrangement facilitates conveyance of the sheet P along a surface of the fixing roller 22 when the sheet P is guided from the first guide surface 301 to the fixing nip N. Since the fixing roller 22 has higher rigidity than the pressing roller 23, the conveyance of the sheet P along the surface of the fixing roller 22 enables not only a conveyance position of the sheet P to be stable but also the sheet P to be conveyed to the fixing nip N with higher accuracy.

Although the arrangement of the first guide surface 301 on the side of the fixing roller 22 can provide the above effects, a friction between the first guide surface 301 and the sheet P increases. This increases a charge on the first guide surface 301. That is, since the sheet P is nipped between the first guide surface 301 and the surface of fixing roller 22 of the fixing nip N, the friction between the sheet P and the first guide surface 301 is high in comparison with a case in which the first guide surface 301 is arranged on the line tangent N2 or the side closer to the pressing roller 23.

Even in such a case, the arrangement of the first guide surface 301 parallel to the line tangent N2 in the guide 30 of the present exemplary embodiment can reduce the charge on the first guide surface 301. Accordingly, even if a friction between the sheet P and the first guide surface 301 is increased, the arrangement of the first guide surface 301 on the side of the fixing roller 22 can prevent the charge on the first guide surface 301 from being excessively large. Hence, a toner image on the surface of the sheet P does not tend to be affected.

Since the guide 30 is disposed near an inlet of the fixing nip N, temperature of the guide 30 is liable to increase. Hence, the guide 30 needs to have resistance to heat. Moreover, a user may touch the guide 30 when dealing with a paper jam. Thus, the guide 30 needs to be made of a material that can keep a surface temperature to 80 degrees Celsius or below. Moreover, the guide 30 needs to have surface smoothness so that a friction resistance is not increased when the guide 30 guides the sheet P.

Therefore, the guide 30 of the present exemplary embodiment is made of a heat-resistant resin material such as liquid crystal polymer (LCP) that is capable of forming a smooth surface and has good size stability. The resin material can be mixed with a reinforcing filler to maintain heat resistance and strength.

However, there is a possibility that the mixture may be deposited on the surface of the guide 30. In some cases, such deposition of the mixture can affect the surface smoothness of the guide 30. Consequently, the mixture is not used in the present exemplary embodiment. Moreover, an amount of a material such as carbon to be blended is set to be low from a molding standpoint.

If a surface roughness of the first guide surface 301 is excessively low, a contact area between the first guide surface 301 and the sheet P increases. This may cause an increase in a charge on the guide 30. On the other hand, if a surface roughness of the first guide surface 301 excessively high, the rough surface may interrupt guidance of the sheet P.

Herein, as for the first guide surface 301 of the present exemplary embodiment, a surface roughness can be determined in consideration of charge protection. The surface roughness of the first guide surface 301 is set to approximately 50 μm to approximately 150 μm.

The surface roughness of the first guide surface 301 can be set by a crimping process that is performed on the surface of the first guide surface 301. However, as long as the above surface roughness can be acquired, other processes can be employed.

Hereinafter, a fixing device of another exemplary embodiment of the present exemplary embodiment is described with reference to FIG. 6. The fixing apparatus of the present exemplary embodiment is applied to a monochrome image forming apparatus 1000 illustrated in FIG. 6.

Figure 6:
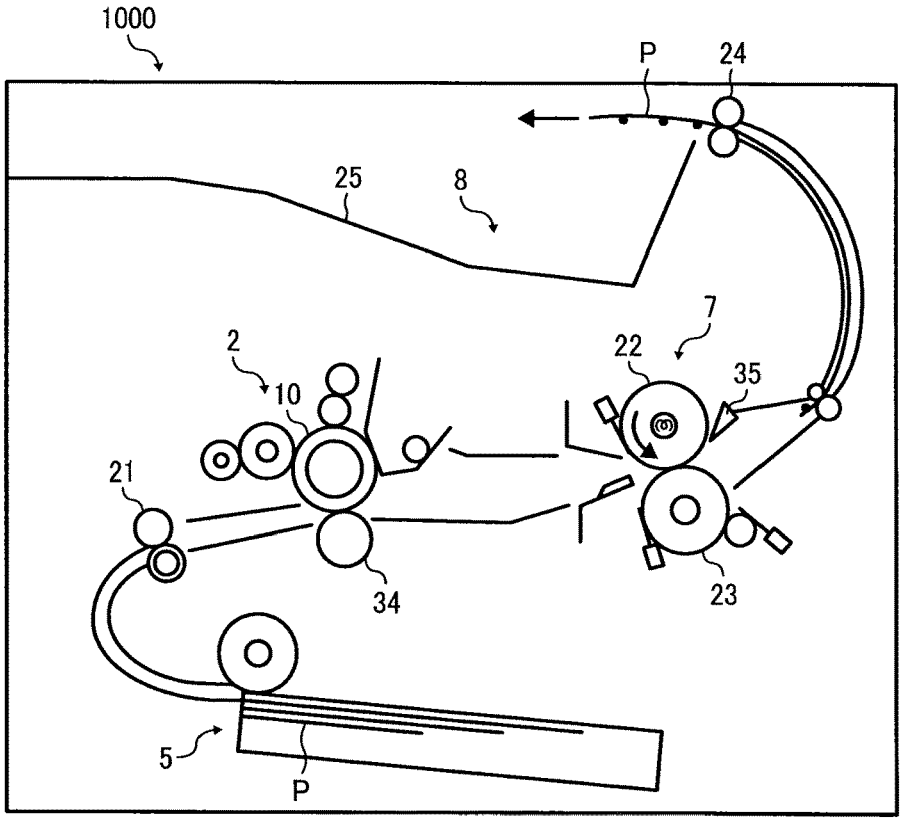
FIG. 6 is a schematic diagram of an image forming apparatus including a fixing device according to another exemplary embodiment of the present invention.

First, a description is given mainly of differences between the image forming apparatus 1 illustrated in FIG. 1 and the image forming apparatus 1000 illustrated in FIG. 6.

The image forming apparatus 1000 of the present exemplary embodiment includes a sheet feeding unit 5, an image forming unit 2, a fixing device 7, and an sheet ejection unit 8.

The image forming unit 2 includes an exposure device, a developing device, a cleaning unit. In the image forming unit 2, a toner stored in the developing device is supplied to a photoconductor drum 10 as an opposite rotator, so that an electrostatic latent image on the photoconductor drum 10 becomes visible as a toner image.

Meanwhile, a registration roller 21 times conveyance of a sheet P fed from the sheet feeding unit 5 to convey the sheet P to a nip portion at a transfer roller 34 as a transfer rotator. In the nip portion, the toner image is transferred to the sheet P.

The sheet P with the transferred image is conveyed to the fixing device 7 via a conveyance path, so that the toner image is fixed on the sheet P with heat and pressure applied by a fixing roller 22 and a pressing roller 23.

The sheet P with the fixed image is separated from the fixing roller 22 by a separation unit 35, and then further conveyed to a downstream side.

Subsequently, in a sheet ejection unit 8, the sheet P is ejected by an ejection roller pair 24 to an ejection tray 25.

Figure 7:
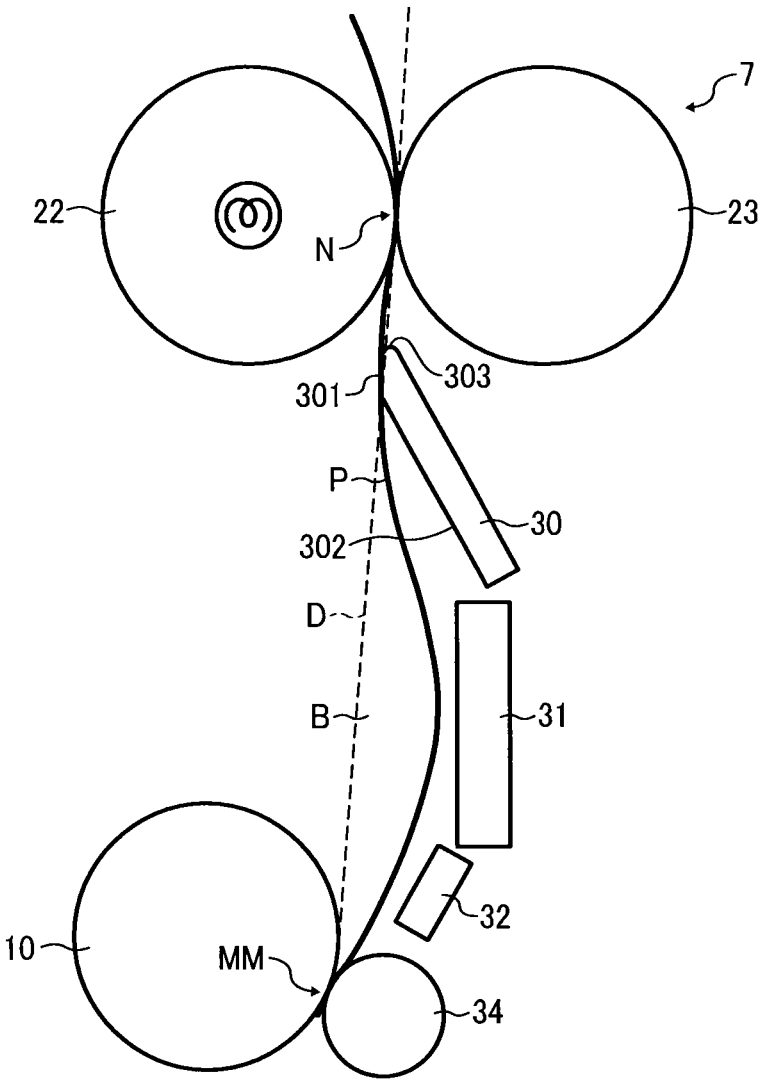
FIG. 7 is a sectional view illustrating a configuration of the fixing device illustrated in FIG. 6 and the periphery thereof.
Figure 8:
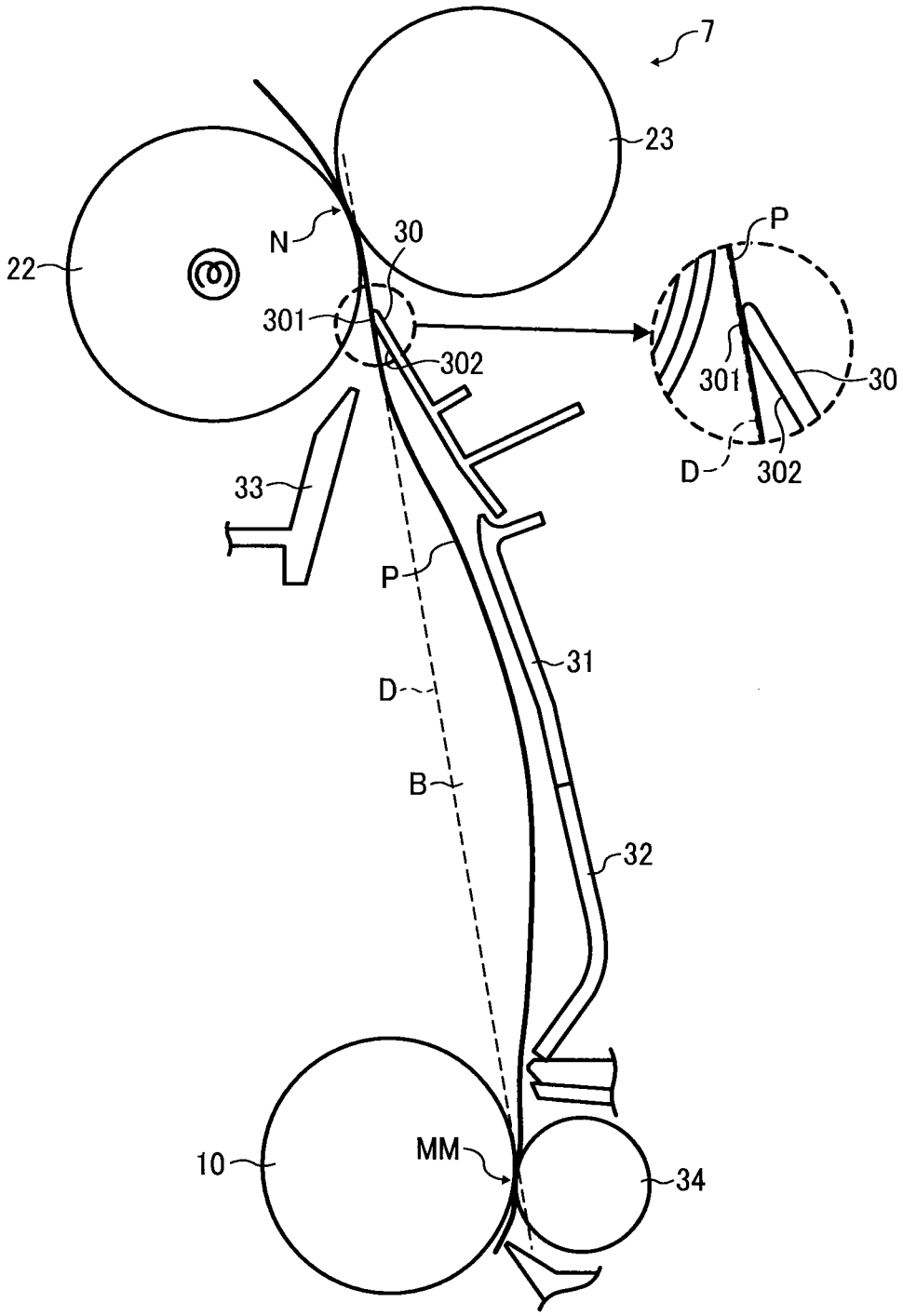
FIG. 8 is a detailed diagram of the configuration illustrated in FIG. 7.
Figure 9:
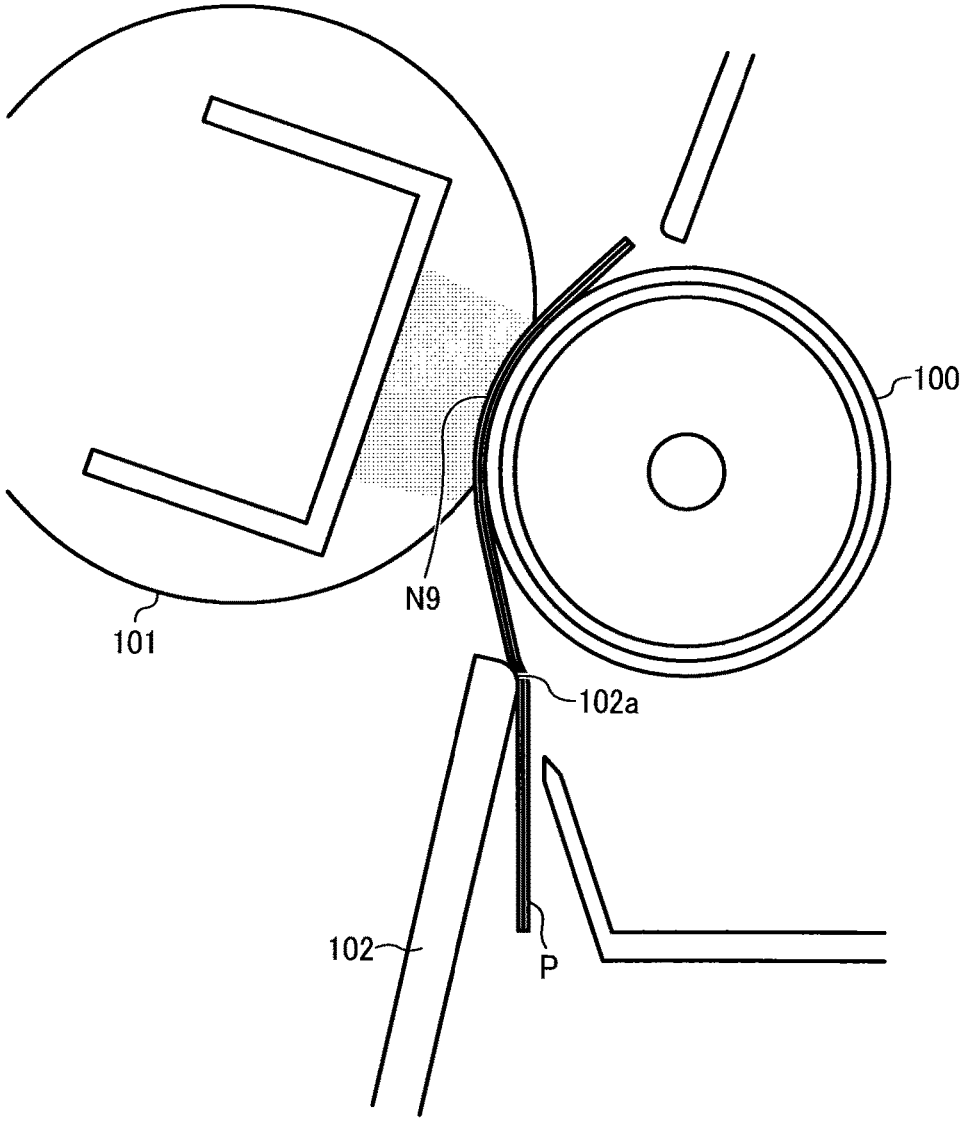
FIG. 9 PRIOR ART
FIG. 9 is a schematic diagram of a related-art fixing device.

FIG. 7 is a diagram illustrating a configuration of the fixing device 7 and the periphery thereof according to the present exemplary embodiment, and FIG. 8 is a detailed diagram of the configuration illustrated in FIG. 7 and includes a relative position of each components of the fixing device 7. In the fixing device 7 as illustrated in FIGS. 7 and 8, a first guide surface 301 of a guide 30 is provided parallel to a common line tangent D to the fixing roller 22 and the photoconductor drum 10 (in an example illustrated in FIGS. 7 and 8, one portion of the line tangent D matches the first guide surface 301). The line tangent D to the fixing roller 22 and the photoconductor drum 10 is approximated to a conveyance path 6 (see FIG. 1) on which the sheet P is conveyed from a transfer nip MM to a fixing nip N. Thus, the parallel arrangement of the first guide surface 301 to the line tangent D allows the first guide surface 301 to be substantially parallel to the sheet P being conveyed and to contact the sheet P as a plane. Therefore, an electric charge does not tend to be accumulated on the first guide surface 301 when the first guide surface 301 guides the sheet P. This can reduce adverse effects on the toner image. The adverse effects include a case in which an irregularity of the toner image on the surface of the sheet P due to the guide 30 causes image dust particles.

On an upstream side of the fixing nip N in the conveyance direction, an opposite guide 33 is disposed opposite the guide 30. The opposite guide 33 is inclined toward the fixing nip N (or the line tangent D) as it approaches the downstream side from the upstream side in the conveyance direction. This enables the conveyance path along which the sheet P is conveyed to be narrowed toward the fixing nip N, thereby guiding the sheet P in a correct conveyance direction.

The guide 30 can be set as a first guide. In such a case, on an upstream side of the first guide 30 in the conveyance direction, a second guide 31 and a third guide 32 for guiding a sheet P are arranged on the side of the pressing roller 23 relative to the line tangent D (the side opposite the first guide surface 301 with the line tangent D therebetween). Moreover, a space B is provided between the line tangent D and the first guide 30, the second guide 31, the third guide 32, and a transfer roller 34. The space B serves as a predetermined area in which the sheet P can pass.

A rotation speed of each of the fixing roller 22 and the pressing roller 23 is set to be lower than that of each of the transfer roller 34 and the photoconductor drum 10. A linear velocity in the fixing nip N is lower than that in the transfer nip MM, so that the sheet P is prevented from being pulled toward the fixing device 7. Herein, a linear velocity difference between the fixing nip N and the transfer nip MM causes slack of the sheet P. However, the sheet P can be slackened off to absorb the slack in the space B.

In a case in which the second guide 31 and the third guide 32 are arranged on the line tangent D or the side closer to the fixing roller 22, the sheet P slides against the second guide 31 or the third guide 32 with a large friction force when being conveyed from the transfer nip MM to the fixing nip N. This charges the second guide 31 and the third guide 32, causing a failure such as the aforementioned image dust particles.

In the present exemplary embodiment, the first guide 30, the second guide 31, and the third guide 32 are arranged on the side of the pressing roller 23 relative to the line tangent D. Such arrangement enables the sheet P to be slackened toward the pressing roller 23 in the space B, thereby preventing a large friction force from being generated due to strong slide of the sheet P against the second guide 31 and the third guide 32. The second guide 31 and the third guide 32 can be provided as one unit, or three or more guides can be arranged.

In the present exemplary embodiment, the first guide surface 301 can be arranged on the side of the fixing roller 22 relative to the line tangent D.

According to the fixing device of the exemplary embodiment of the present invention, therefore, a guide surface for guiding a recording medium is provided parallel to a line tangent to a fixing rotator and a pressing rotator. This construction enables the recording medium to contact the guide surface as a plane without any projection of the guide surface with respect to the recording medium when the recording medium is conveyed from the guide surface to a fixing nip. Accordingly, a charge on the guide surface when the recording medium is guided can be low in comparison with a case in which a recording medium contacts a projection of the guide surface as a point. Hence, adverse effects such as image irregularities that occur when a developer image on the recording medium surface is fixed can be reduced.

Therefore, at least one exemplary embodiment of the present invention can provide a fixing device including a low-cost guide that can guide a recording medium to a fixing nip and reduce a charge amount when a recoding medium is guided.

Embodiments of the present invention have been described above with reference to specific exemplary embodiments. Note that the present disclosure is not limited to the details of the embodiments described above, but various modifications and enhancements are possible without departing from the scope thereof.

In the exemplary embodiment described above with reference to FIG. 6, an image forming apparatus employing a direct transfer method is used as an example. However, such an exemplary embodiment can be applied to an image forming apparatus employing an intermediate transfer method as illustrated in FIG. 1. Moreover, a configuration of the image forming apparatus described above with reference to FIG. 1 can be applied to the image forming apparatus employing the direct transfer method illustrated in FIG. 6.

What is claimed is:

1. A fixing device comprising:

a fixing rotator;

a pressing rotator to form a fixing nip with the fixing rotator; and a guide to guide a recording medium to the fixing nip, the guide including a first guide surface that is a chamfered corner of the guide parallel to a line tangent to the fixing rotator and the pressing rotator at the fixing nip, the line crossing a portion of the guide, and a second guide surface continuous with the first guide surface through a curved portion, the second guide surface extending in a length direction of the guide, wherein the first guide surface and the second guide surface each contact a surface of the recording medium to guide the recording medium.

2. The fixing device according to claim 1, wherein the first guide surface comprises a downstream end portion in a recording medium conveyance direction, and wherein the downstream end portion of the first guide surface is provided on a fixing rotator side relative to the line tangent to the fixing rotator and the pressing rotator.

3. The fixing device according to claim 1, wherein the first guide surface is provided on a fixing rotator side relative to the line tangent to the fixing rotator and the pressing rotator.

4. The fixing device according to claim 1, wherein the second guide surface is on an upstream side of the first guide surface in a recording medium conveyance direction, and the second guide surface has an inclined area inclining from the pressing rotator toward the fixing rotator from an upstream side to a downstream side in the recording medium conveyance direction.

5. The fixing device according to claim 1, wherein the first guide surface is made of a resin material.

6. A fixing device comprising:

a fixing rotator;

a pressing rotator to form a fixing nip with the fixing rotator; and a guide to guide a recording medium to the fixing nip, the guide including a guide surface that contacts a surface of the recording medium to guide the recording medium and is parallel to a line tangent to the fixing rotator and the pressing rotator at the fixing nip, the line crossing a portion of the guide, wherein the guide surface is made of a liquid crystal polymer and has a surface roughness of approximately 50 μm to approximately 150 μm.

7. The fixing device according to claim 1, wherein the first guide surface is crimped.

8. An image forming apparatus comprising the fixing device according to claim 1.

9. A fixing device comprising:

a fixing rotator;

a pressing rotator to form a fixing nip with the fixing rotator;

a guide to guide a recording medium to the fixing nip, the guide including a first guide surface that is a chamfered corner of the guide provided on an upstream side of the fixing rotator in a recording medium conveyance direction and parallel to a common line tangent to the fixing rotator and an opposite rotator that is disposed opposite a transfer rotator transferring an image to the recording medium to form a transfer nip with the transfer rotator, the line being at the transfer nip and crossing a portion of the guide, wherein the guide includes a second guide surface continuous with the first guide surface through a curved portion, the second guide surface extending in a length direction of the guide, wherein the first guide surface and the second guide surface each contact a surface of the recording medium to guide the recording medium.

10. The fixing device according to claim 9, wherein the second guide surface is on an upstream side of the first guide surface in the recording medium conveyance direction, and the second guide surface has an inclined area inclining from the pressing rotator toward the fixing rotator from an upstream side to a downstream side in the recording medium conveyance direction.

11. The fixing device according to claim 9, wherein the first guide surface is made of a resin material.

12. A fixing device comprising:

a fixing rotator;

a pressing rotator to form a fixing nip with the fixing rotator;

a guide to guide a recording medium to the fixing nip, the guide including a guide surface that contacts a surface of the recording medium to guide the recording medium and is provided on an upstream side of the fixing rotator in a recording medium conveyance direction and parallel to a common line tangent to the fixing rotator and an opposite rotator that is disposed opposite a transfer rotator transferring an image to the recording medium to form a transfer nip with the transfer rotator, the line being at the transfer nip and crossing a portion of the guide, wherein the guide surface is made of liquid crystal polymer and has a surface roughness of approximately 50 μm to approximately 150 μm.

13. The fixing device according to claim 9, therein the first guide surface is crimped.

14. An image forming apparatus comprising the fixing device according to claim 9.

15. The fixing device according to claim 1, wherein the line is coincident with the first guide surface.

16. The fixing device according to claim 1, wherein the curved portion has a radius of 0.2 mm to 0.3 mm.

* * * * *